US006432220B1

(12) United States Patent
Lindemann et al.

(10) Patent No.: US 6,432,220 B1
(45) Date of Patent: Aug. 13, 2002

(54) PROCESS FOR THE PRELIMINARY TREATMENT OF A METALLIC WORKPIECE BEFORE COATING

(75) Inventors: Johannes Lindemann, Rheinbreitbach; Karl Manderscheid, Huerth-Fischenich; Rainer Kluth, Bonn; Dirk Bohnes, Kerpen, all of (DE)

(73) Assignee: Aware Chemicals L.L.C., Miami, FL (US)

( * ) Notice: Subject to any disclaimer, the term of this patent is extended or adjusted under 35 U.S.C. 154(b) by 0 days.

(21) Appl. No.: 09/720,388

(22) PCT Filed: Jun. 15, 1999

(86) PCT No.: PCT/EP99/04125

§ 371 (c)(1),
(2), (4) Date: Mar. 2, 2001

(87) PCT Pub. No.: WO99/67442

PCT Pub. Date: Dec. 29, 1999

(30) Foreign Application Priority Data

Jun. 24, 1998 (AT) ..... 1091/98

(51) Int. Cl.[7] ..... C23G 1/02; C11D 3/37

(52) U.S. Cl. ..... 134/41; 134/3; 427/307; 427/327; 510/365; 510/434; 510/480

(58) Field of Search ..... 134/3, 28, 41; 510/260, 261, 365, 434, 480; 427/307, 327

(56) References Cited

U.S. PATENT DOCUMENTS

| | | | | |
|---|---|---|---|---|
| 3,578,508 A | | 5/1971 | Pearlman | 148/6.14 |
| 4,299,640 A | | 11/1981 | Erickson | 156/110 |
| 5,443,651 A | * | 8/1995 | Kalota et al. | 134/2 |
| 5,656,646 A | * | 8/1997 | Perner et al. | 510/223 |
| 5,785,896 A | | 7/1998 | Rother et al. | 252/392 |
| 5,977,053 A | * | 11/1999 | Groth et al. | 510/480 |
| 6,245,157 B1 | * | 6/2001 | Gerlach et al. | 134/22.1 |

FOREIGN PATENT DOCUMENTS

| | | |
|---|---|---|
| EP | 0 700 987 | 3/1996 |
| EP | 0 710 733 | 5/1996 |
| EP | 0 757 094 | 2/1997 |
| EP | 0 821 054 | 1/1998 |
| WO | WO 95/10583 | 4/1995 |
| WO | WO 95/24456 | 9/1995 |
| WO | WO 96/27696 | 9/1996 |
| WO | WO 97/04052 | 2/1997 |

OTHER PUBLICATIONS

Silverman D.C. et al.: Effects of pH on Corrosion Inhibition of Steel by Polyaspartic Acid Corrosion, vol. 51, No. 11, Nov. 1, 1995, pp. 818–825, XP000542444 ISSN: 0010–9312 abstract.

* cited by examiner

*Primary Examiner*—Randy Gulakowski
*Assistant Examiner*—Saeed Chaudhry
(74) *Attorney, Agent, or Firm*—Stephen D. Harper

(57) ABSTRACT

A process for the preliminary treatment of a metallic workpiece before coating is disclosed. The surface to be coated is cleaned with a solution containing a degreasing agent and coated with a corrosion-inhibiting layer. In order to obtain particularly advantageous conditions, the invention proposes that the surface of a workpiece to be coated be treated with a solution of polyaspartic acid to apply a corrosion-resistant coating.

13 Claims, 1 Drawing Sheet

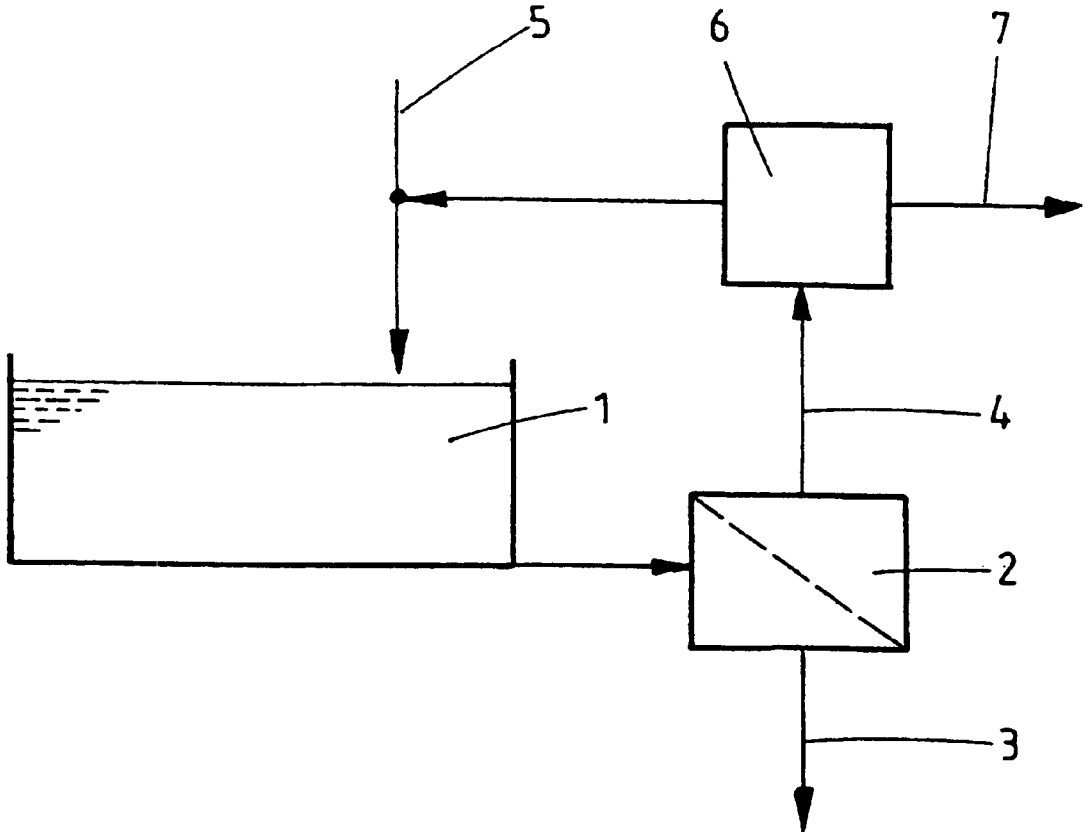
5
6
7
1
4
2
3

PROCESS FOR THE PRELIMINARY TREATMENT OF A METALLIC WORKPIECE BEFORE COATING

This invention relates to a process for the pretreatment of a metal workpiece for painting, the surface to be painted being cleaned with a solution containing degreasing agents and being coated with a corrosion-inhibiting layer.

The surfaces of metal workpieces to be painted have to be cleaned and degreased before painting in order to establish the conditions required for durable painting, i.e. for firm paint adhesion to the workpiece surface. To this end, the surfaces of the workpiece to be painted are treated with a solution containing suitable degreasing agents which is either sprayed onto the surfaces to be painted or which serves as a dip bath for the workpiece. After this degreasing step followed by a rinse, the workpieces are phosphated to improve their corrosion resistance. Through this phosphating step, the workpiece surface is oxidatively attacked, resulting in slight erosion of a surface layer. The roughening effect this has on the surface improves the adhesion of the paint subsequently applied. In order to terminate the oxidative surface reaction, the workpiece surface is passivated in another treatment step; thus, overall, the pretreatment of the workpiece is very complicated.

In order to protect soft iron surfaces against the corrosive effect of salt water, it is known (WO 96/27696) that comparatively small amounts of polyaspartic acid can be added to the salt water. The corrosion-inhibiting effect of polyaspartic acid and polyaspartic polymers of polyaspartic acid and its salt or amide is also used in coolants and lubricants for the machining of workpieces (WO 95/10583, WO 95/24456). However, these corrosion-inhibiting additions to liquids with a corrosive effect on metal surfaces do not impart any teaching as to how surfaces of metal workpieces should be treated in readiness for durable painting.

Finally, it is known (WO 95/24456) that an aqueous solution of a polyamino acid of which the amino acid group may contain inter alia aspartic acid can be used to clean a metal surface. Although the metal surface treated with such a solution can be kept from corroding by maintaining a comparatively low pH value of at most 7, the protection against corrosion required for subsequent painting is not achieved in this way.

Accordingly, the problem addressed by the present invention was to develop a process for the pretreatment of a metal workpiece for painting of the type mentioned at the beginning in such a way that the number of process steps involved would be considerably reduced without impairing paint adhesion or endangering corrosion prevention.

The present invention relates to a process for pretreating a metal workpiece for painting, the surface to be painted being cleaned with a solution containing degreasing agents and being coated with a corrosion-inhibiting layer, characterized in that the surface of the workpiece to be painted is treated with a solution of polyaspartic acid for application of a corrosion-inhibiting layer.

The solution containing a degreasing agent is preferably an aqueous solution of a so-called neutral cleaner or an alkaline cleaner. Neutral cleaners generally have a pH value in the range from about 7 to about 9 and contain nonionic surfactants as degreasing agents. Alkaline cleaners are adjusted to pH values above 8.5 by addition of alkalis or alkaline builders. They preferably contain anionic surfactants as degreasing agents.

Any reference in the following to a solution of polyaspartic acid or a copolymer containing aspartic acid is meant to convey that the solution contains the free acid and/or acid anions. It is well-known that the ratio of free acid to acid anions is dependent on the pH value of the solution. The aspartic acid units in polyaspartic acid can be joined together by so-called -linkage or so-called -linkage. In general, both linkage types are present alongside one another in a polymer strand. The ratio of - to -linkages is of no relevance to the present invention. A copolymer containing aspartic acid is a copolymer which contains other monomeric groups besides aspartic acid units. These other monomeric groups may be other amino acids, but also other polymerizable carboxylic acids. Copolymers of which at least 50 mole % and preferably at least 80 mole % consists of aspartic acid are preferably used.

Any brief reference to polyaspartic acid in the following is intended to encompass both polyaspartic acid itself and a copolymer containing aspartic acid.

Through the treatment of the surface of the workpiece to be painted with a solution of polyaspartic acid, the workpiece surface can be covered with a thin organic film of an organic polymer of which the branched structure ensures not only a firm connection with the substrate, but also favorable adhesion promotion of the paint. Accordingly, the use of a polyaspartic acid for pretreating a metal workpiece to be painted, which can be treated with the polyaspartic acid solution in the usual way by dipping or spraying, affords the advantage that, by comparison with phosphating, a treatment step corresponding to passivation is saved so that the risk of corrosion posed by inadequate passivation can be eliminated.

The metal surface coated with a layer of polyaspartic acid may be directly painted. By this is meant that rinsing steps at most, but no other operations, such as for example transport of the workpieces to another processing station, forming or assembly steps, take place between the treatment with the solution containing aspartic acid and painting. However, the described treatment with the solution containing polyaspartic acid may also be used as a temporary corrosion prevention measure. In other words, it provides the metal surface with sufficient protection against corrosion, even without direct painting, for the metal workpieces to be transported, formed or assembled before painting. If such processes do take place, aftertreatment with another solution for strengthening or lengthening the corrosion-inhibiting effect obtained in step b, immediately before the final painting process is preferred. This aftertreatment may be, for example, phosphating, treatment with a solution of chromium compounds, a solution of complex fluorides of boron, silicon, titanium and/or zirconium and/or a solution or dispersion of other organic polymers. The workpiece may be cleaned once more before this aftertreatment.

Particularly favorable conditions in this regard are established if, as in another embodiment of the invention, the surface of the workpiece to be painted—for simultaneous degreasing and coating—is treated with a solution of polyaspartic acid or a polymer containing aspartic acid and a degreasing agent. In this case, a single treatment step can provide both for degreasing and for corresponding corrosion prevention. The solution preferably contains a degreasing agent based on the sodium salt of iminodisuccinic acid. The polyaspartic acid acts as a dispersant for the fatty particles detached from the workpiece surface by the sodium salt of iminodisuccinic, so that the detached fatty particles are kept in dispersion by this dispersant and are prevented from resettling on the workpiece surface. However, the polyaspartic acid not only has a dispersing effect on the fatty particles, it also forms a corrosion-inhibiting surface layer which is of particular advantage to adhesion promotion and which establishes favorable conditions for durable painting, especially since the sodium salt of iminodisuccinic acid provides for corresponding roughening of the workpiece surface.

The ratio by weight of polyaspartic acid to the sodium salt of iminodisuccinic acid should be between 10:1 and 1:10, a minimum polyaspartic acid concentration of 2% having to be established in the solution to obtain the desired effects. Corresponding additives, for example wetting agents or the like, may of course be mixed with the sodium salt of iminodisuccinic acid.

If the solution of the iminodisuccinic acid sodium salt and the polyaspartic acid laden with the fats detached from the workpiece surface is subjected to membrane filtration, the detached fats and impurities can be separated and the solution of the iminodisuccinic acid sodium salt and the polyaspartic acid may be recycled for treatment of the workpiece. This is because the solution of the organic degreasing agent and the polyaspartic acid permeate the membrane filter as permeate while the fats and impurities can be separated as retentate and disposed of. The metal ions dissolved from the workpiece surface by the iminodisuccinic acid sodium salt may then be separated from the permeate to prevent these metal ions from accumulating.

The corrosion prevention achieved where degreasing is carried out with the sodium salt of iminodisuccinic acid may if necessary be increased by subjecting the surface of the workpiece to be painted to another treatment—after degreasing—in a 10 to 40% solution of the polyaspartic acid in order to improve coating with the organic polymer formed by the polyaspartic acid. The solution accumulating from this aftertreatment may of course also be subjected to membrane filtration to enable the polyaspartic acid to be reused for treatment of the workpiece after the removal of unwanted impurities.

The process according to the invention is described in more detail in the following with reference to the accompanying drawing which is a block diagram of an installation for carrying out the process.

In the embodiment illustrated, the installation for pretreating a metal workpiece, more particularly of steel plate, comprises a dip tank 1 for treatment of the workpiece which is filled with an aqueous solution of a degreasing agent based on the sodium salt of iminodisuccinic acid and a polyaspartic acid. The workpieces to be treated are dipped into the tank 1 in order on the one hand to be cleaned and degreased and on the other hand to be coated with a corrosion-inhibiting organic polymer layer. The fats and impurities dissolved by the use of iminodisuccinic acid sodium salt are kept in dispersion in the bath by the polyaspartic acid because the polyaspartic acid acts as a dispersant. The particles in question are thus prevented from resettling on the workpiece surface, which can be painted after removal of the workpiece from the dip tank 1 and subsequent rinsing, unless the corrosion-inhibiting layer is reinforced by another dip in a polyaspartic acid solution in a subsequent treatment step.

In order not to impair the effect of the dip bath by the increase in concentration of the particles detached from the workpiece surface, the dip tank 1 is followed by a membrane filtration unit 2 in which the fatty particles in particular can be separated from the solution. The retentate is discharged from the membrane filtration unit 2 through an outlet 3 while the permeate, which contains the organic degreasing agent and the polyaspartic acid, is returned to the dip tank 1 through a return line 4. Bath losses are replaced via a feed line 5 through which the bath can be replenished with fresh solution of the degreasing agent and the polyaspartic acid.

Since the use of iminodisuccinic acid sodium salt also detaches metal ions from the surface of the workpiece, appropriate provision also has to be made for the removal of those metal ions. In the block diagram of the installation, this is indicated by an ion exchanger 6 which is connected to the membrane filtration unit 2. The metals collecting in the ion exchanger 6 can be disposed of through the line 7.

It presumably need not be especially emphasized that the present invention is not confined to the embodiment illustrated in the drawing. The dip treatment may be replaced, for example, by a conventional spray treatment, the only important factor of course being that a polyaspartic acid should be used, advantageously in conjunction with a degreasing agent based on the sodium salt of iminodisuccinic acid, for corrosion prevention and for improving adhesion of the paint.

In one special embodiment of the present invention, the treatment of the metal surface with polyaspartic acid or a copolymer containing aspartic acid is used as a temporary corrosion prevention measure. In other words, the workpiece is stored and/or transported over a relatively long period (days to weeks) before the final corrosion prevention treatment. In addition, processing steps, such as for example forming or assembly (welding, flanging), may be carried out before the final corrosion prevention treatment. Forming processes are facilitated by the polymer layer on the metal surface. After such processes, the metal surface is generally soiled so that it has to be cleaned once again before the final corrosion prevention treatment. In this case, the preliminary coating with polyaspartic acid or a polymer containing polyaspartic acid has the advantage that the impurities can be removed more easily in such a subsequent cleaning step.

The surface to be painted is then treated before painting with another solution which forms a conversion layer on the surface. This treatment may be in particular a layer-forming phosphating step, as typically applied in automobile manufacture and in the domestic appliance industry. However, the phosphating step may also be replaced by chromating, treatment with a solution of complex fluorides, more particularly the elements boron, silicon, titanium and/or zirconium, and/or a solution of other organic polymers. These other organic polymers may be, for example, polymers or copolymers of acrylic acid or methacrylic acid or polyvinyl phenols.

Any general reference in the foregoing to metal workpieces is meant to apply in particular to workpieces of metals of the type widely used in the vehicle, furniture or domestic appliance industries. The workpieces in question are in particular workpieces of steel, galvanized steel or alloy-galvanized steel or of aluminum or its alloys and also workpieces of magnesium or magnesium alloys.

What is claimed is:

1. A process for pretreating a surface of a metal workpiece to be painted, said process comprising cleaning said surface with a solution containing degreasing agents and treating said surface with a solution of polyaspartic acid to form on said surface a corrosion-inhibiting layer.

2. A process as claimed in claim 1, wherein simultaneous degreasing and coating of the surface of the workpiece to be painted is accomplished by treating the surface with a solution comprising polyaspartic acid and the sodium salt of iminodisuccinic acid.

3. A process as claimed in claim 2, wherein the ratio by weight of polyaspartic acid to the sodium salt of iminodisuccinic acid in the solution comprising both of these substances is between 10:1 and 1:10 and the polyaspartic acid concentration in said solution is at least 2%.

4. A process as claimed in claim 3, wherein said solution comprising polyaspartic acid and the sodium salt of iminodisuccinic acid after becoming laden with fats detached from the workpiece surface, is subjected to membrane filtration to form a permeate containing polyaspartic acid and the sodium salt of iminodisuccinic acid and a retentate containing said fats, the permeate being recirculated for surface treatment of the workpiece and the retentate being disposed of.

5. A process as claimed in claim 4, wherein free metal ions are removed from the permeate before it is recirculated for treatment of the workpiece.

6. A process as claimed in claim 5, wherein, after degreasing, the surface of the workpiece to be painted is subjected to another treatment in a 10 to 40% solution of polyaspartic acid.

7. A process as claimed in claim 3, wherein, after degreasing, the surface of the workpiece to be painted is subjected to another treatment in a 10 to 40% solution of polyaspartic acid.

8. A process as claimed in claim 4, wherein, after degreasing, the surface of the workpiece to be painted is subjected to another treatment in a 10 to 40% solution of polyaspartic acid.

9. A process as claimed in claim 2, wherein said solution comprising polyaspartic acid and the sodium salt of iminodisuccinic acid, after becoming laden with fats detached from the workpiece surface, is subjected to membrane filtration to form a permeate containing polyaspartic acid and the sodium salt of iminodisuccinic acid and a retentate containing said fats, the permeate being recirculated for surface treatment of the workpiece and the retentate being disposed of.

10. A process as claimed in claim 9, wherein free metal ions are removed from the permeate before it is recirculated for treatment of the workpiece.

11. A process as claimed in claim 10, wherein, after degreasing, the surface of the workpiece to be painted is subjected to another treatment in a 10 to 40% solution of polyaspartic acid.

12. A process as claimed in claim 9, wherein, after degreasing, the surface of the workpiece to be painted is subjected to another treatment in a 10 to 40% solution of polyaspartic acid.

13. A process as claimed in claim 2, wherein, after degreasing, the surface of the workpiece to be painted is subjected to another treatment in a 10 to 40% solution of polyaspartic acid.

* * * * *

UNITED STATES PATENT AND TRADEMARK OFFICE

CERTIFICATE OF CORRECTION

PATENT NO. : 6,432,220 B1
DATED : August 13, 2002
INVENTOR(S) : Lindemann et al.

It is certified that error appears in the above-identified patent and that said Letters Patent is hereby corrected as shown below:

Column 5,
Line 5, after "acid", insert therefor -- , --.

Signed and Sealed this

Twenty-fifth Day of March, 2003

JAMES E. ROGAN
*Director of the United States Patent and Trademark Office*